US011839336B1

(12) United States Patent
Allen et al.

(10) Patent No.: US 11,839,336 B1
(45) Date of Patent: Dec. 12, 2023

(54) PORTABLE TOILET AND POP-UP ENCLOSURE

(71) Applicants: Justin Allen, Bowie, MD (US); Sharneise Allen, Bowie, MD (US)

(72) Inventors: Justin Allen, Bowie, MD (US); Sharneise Allen, Bowie, MD (US)

( * ) Notice: Subject to any disclaimer, the term of this patent is extended or adjusted under 35 U.S.C. 154(b) by 22 days.

(21) Appl. No.: 17/700,634

(22) Filed: Mar. 22, 2022

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/449, 476
See application file for complete search history.

(56) References Cited

U.S. PATENT DOCUMENTS 1,538,311 A 5/1925 Anticknap
D302,583 S 8/1989 Lemmeyer
5,937,452 A 8/1999 Brewer
5,974,597 A 11/1999 Conwell
6,305,396 B1 * 10/2001 Zheng ..... A63B 9/00 135/126
6,378,142 B1 4/2002 Gray
6,718,565 B1 4/2004 Cruz
6,752,163 B2 * 6/2004 Zheng ..... A63B 69/0071 135/117
D514,747 S * 2/2006 Bertoli ..... D30/108
7,849,866 B1 12/2010 Mangum
8,499,370 B1 * 8/2013 Felicetta ..... A47K 11/04 4/479
D691,689 S * 10/2013 Pescovitz ..... D21/838
11,369,239 B2 * 6/2022 Yang ..... A47K 11/04
11,576,494 B1 * 2/2023 You ..... A47C 3/40
2006/0169310 A1 * 8/2006 Qian ..... A47K 11/04 135/128
2013/0306121 A1 * 11/2013 Hung Lau ..... A01M 31/025 135/117
2015/0305580 A1 * 10/2015 Likewise ..... E03D 9/00 4/483
2020/0054955 A1 2/2020 Zaitouni

FOREIGN PATENT DOCUMENTS

WO 2008089319 7/2008

* cited by examiner

*Primary Examiner* — Huyen D Le
(74) *Attorney, Agent, or Firm* — Kyle A. Fletcher, Esq.

(57) ABSTRACT

The portable toilet and pop-up enclosure includes a portable toilet and a pop-up enclosure. The portable toilet and pop-up enclosure may be adapted to provide privacy to a child while the child uses the portable toilet by enclosing the portable toilet and the child within the pop-up enclosure. The portable toilet may collect feces and urine for disposal at a later time. The pop-up enclosure may be adapted to block the view of the portable toilet and the child while providing ventilation and access by a parent. Both the portable toilet and the pop-up enclosure may collapse for transportation and/or storage.

17 Claims, 6 Drawing Sheets

PORTABLE TOILET AND POP-UP ENCLOSURE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of portable toilets and accessories for children, more specifically, a portable toilet and pop-up enclosure.

SUMMARY OF INVENTION

The portable toilet and pop-up enclosure comprises a portable toilet and a pop-up enclosure. The portable toilet and pop-up enclosure may be adapted to provide privacy to a child while the child uses the portable toilet by enclosing the portable toilet and the child within the pop-up enclosure. The portable toilet may collect feces and urine for disposal at a later time. The pop-up enclosure may be adapted to block the view of the portable toilet and the child while providing ventilation and access by a parent. Both the portable toilet and the pop-up enclosure may collapse for transportation and/or storage.

An object of the invention is to provide a portable toilet for use by a child.

Another object of the invention is to provide a pop-up enclosure to provide privacy for the child during use of the portable toilet.

A further object of the invention is to provide a portable toilet and a pop-up enclosure that may collapse for transportation and storage and may expand for use.

Yet another object of the invention is to provide ventilation with the pop-up enclosure and apertures for child and parent access to the interior of the pop-up enclosure.

These together with additional objects, features and advantages of the portable toilet and pop-up enclosure will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable toilet and pop-up enclosure in detail, it is to be understood that the portable toilet and pop-up enclosure is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable toilet and pop-up enclosure.

It is therefore important that the claims be regarded as including such equivalent construction insofar as they do not depart from the spirit and scope of the portable toilet and pop-up enclosure. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
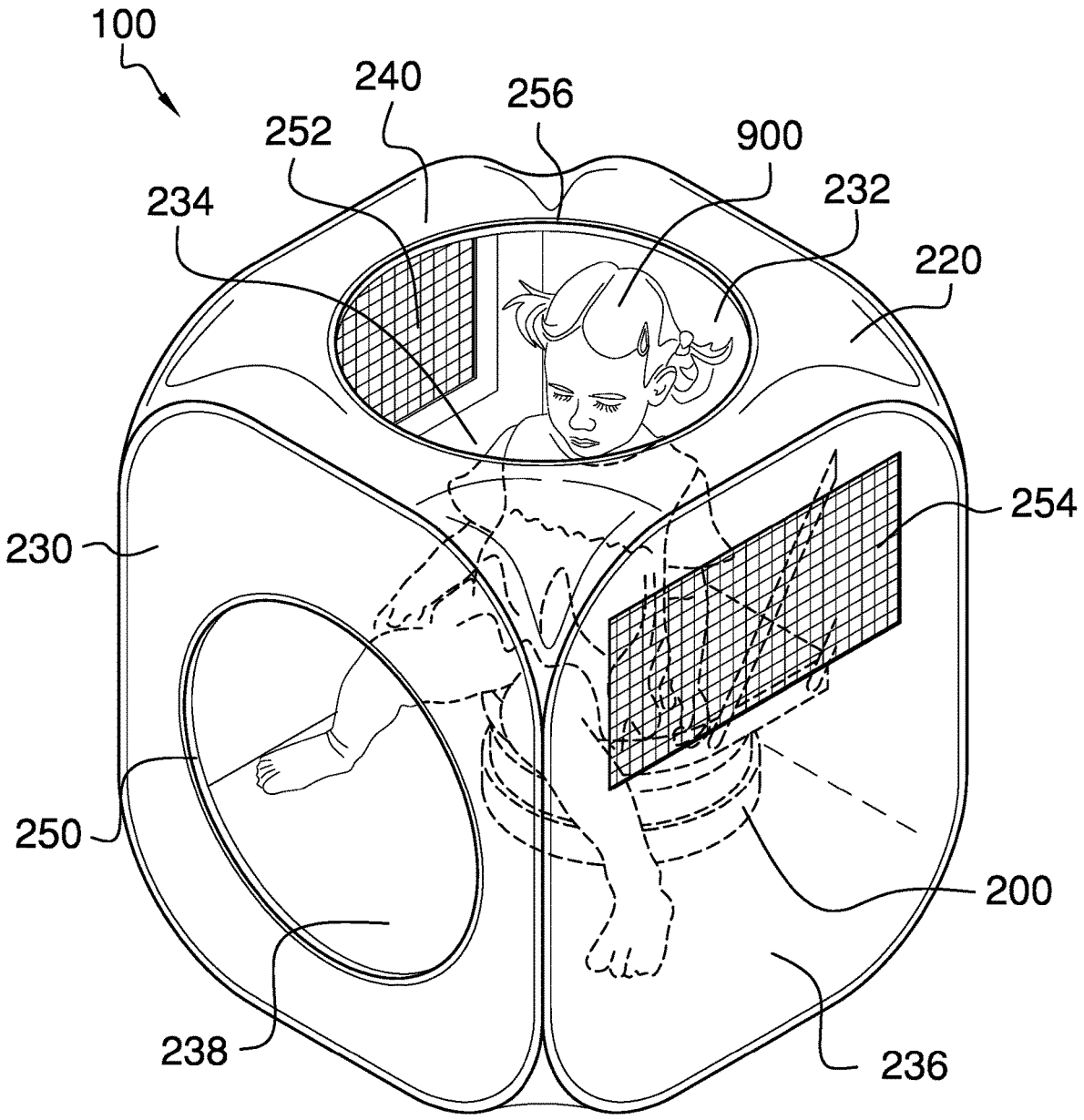
FIG. 1 is an isometric view of an embodiment of the disclosure.
Figure 2:
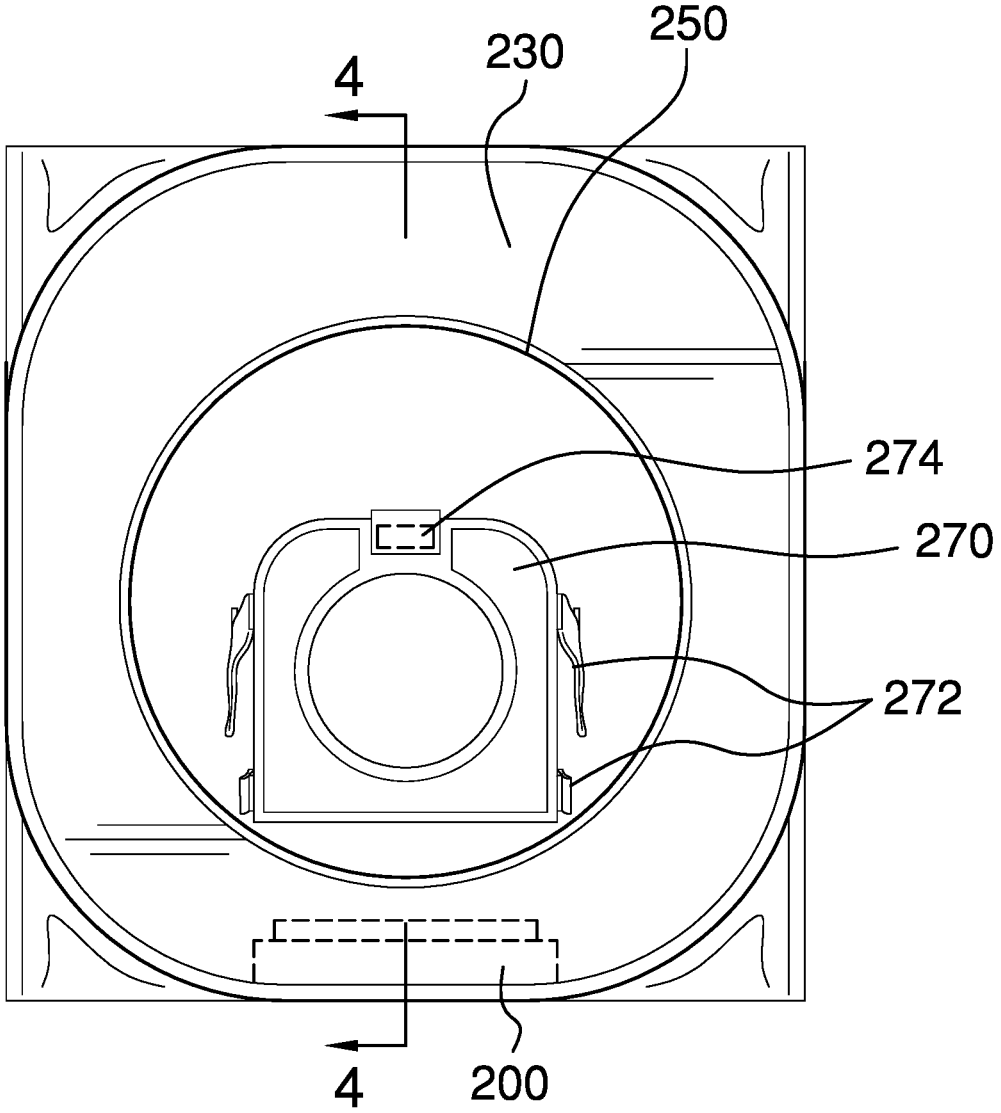
FIG. 2 is a front view of an embodiment of the disclosure.
Figure 3:
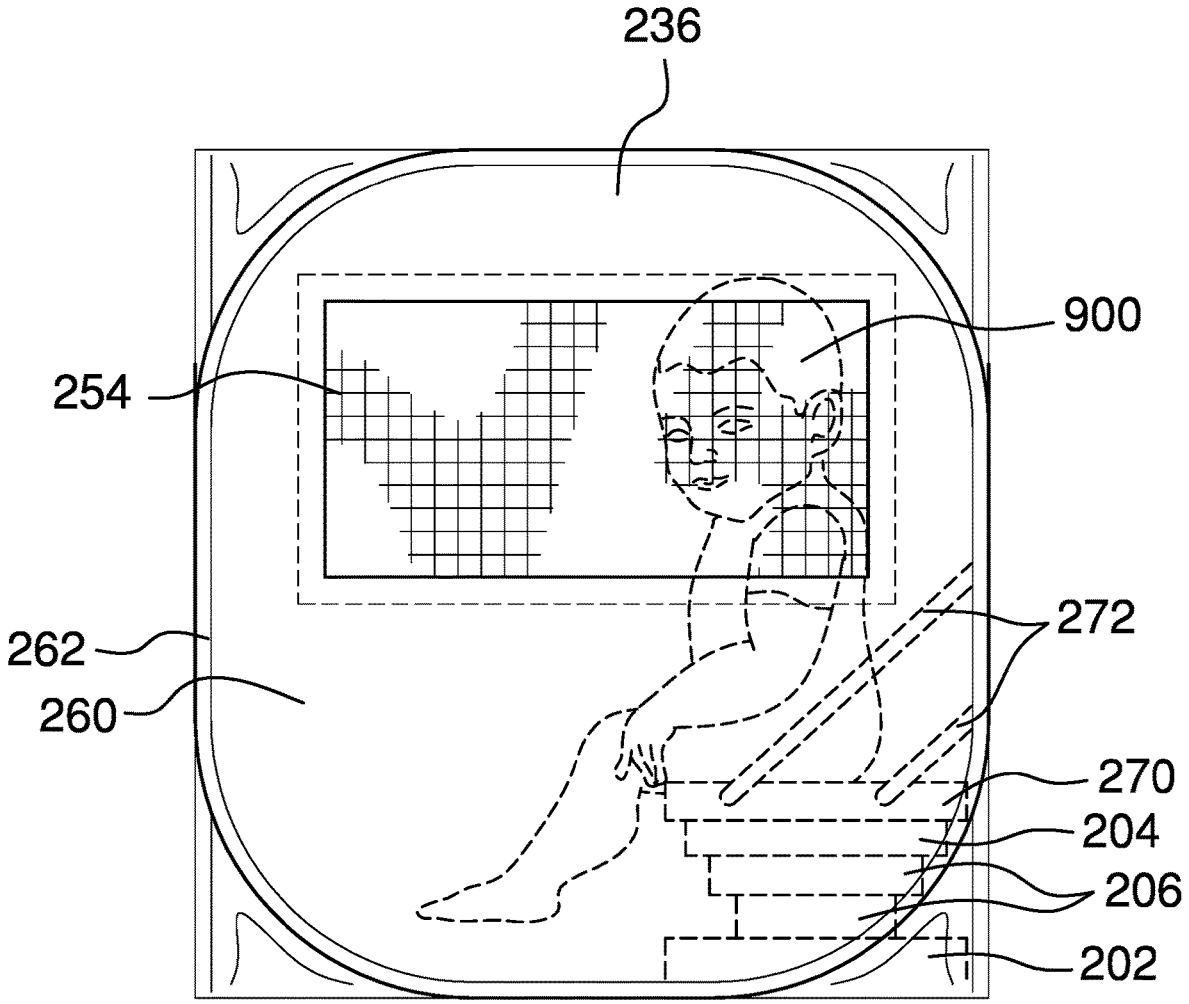
FIG. 3 is a side view of an embodiment of the disclosure.
Figure 4:
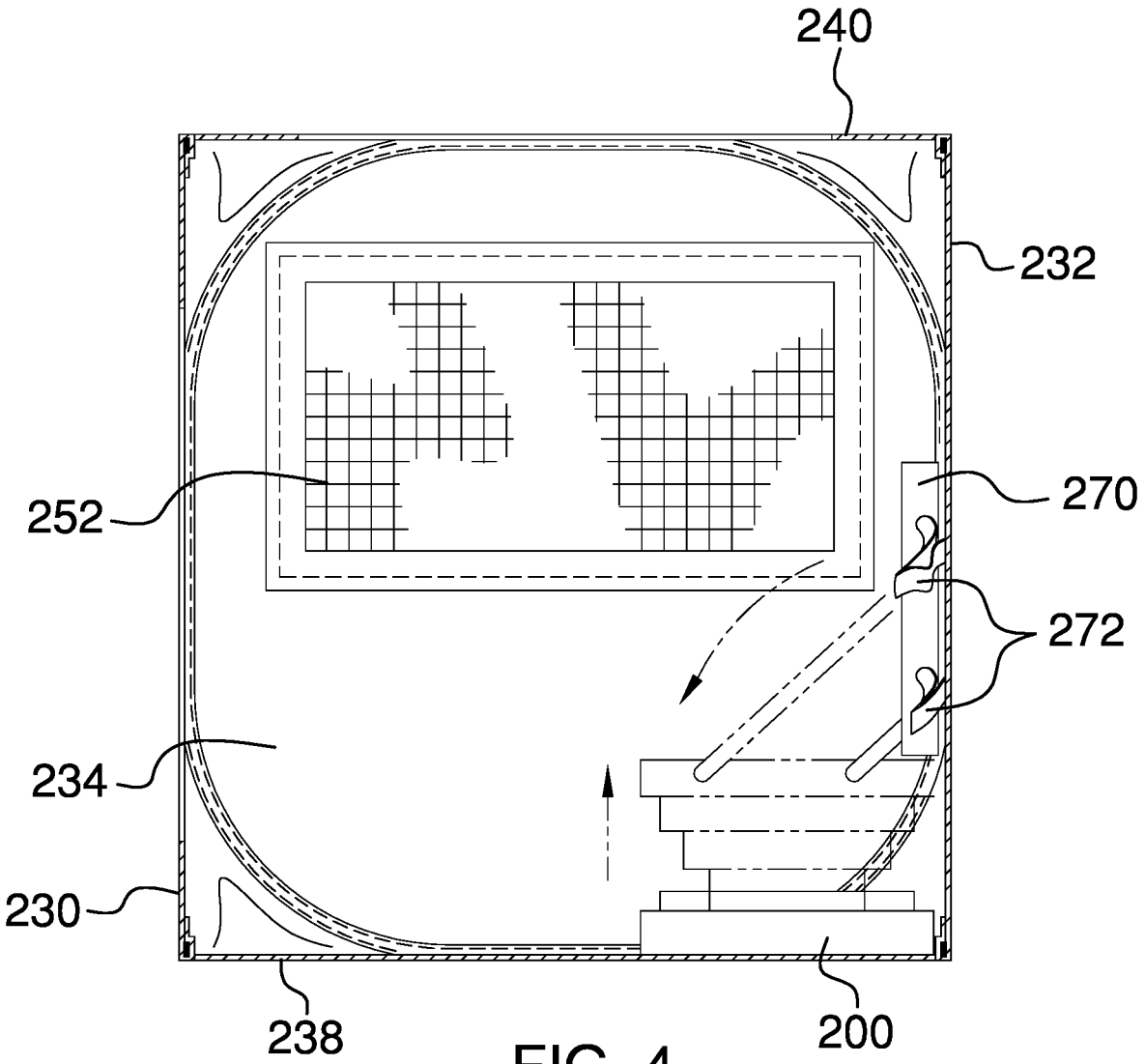
FIG. 4 is a cross-sectional view of an embodiment of the disclosure across 4-4 as shown in FIG. 2.
Figure 5:
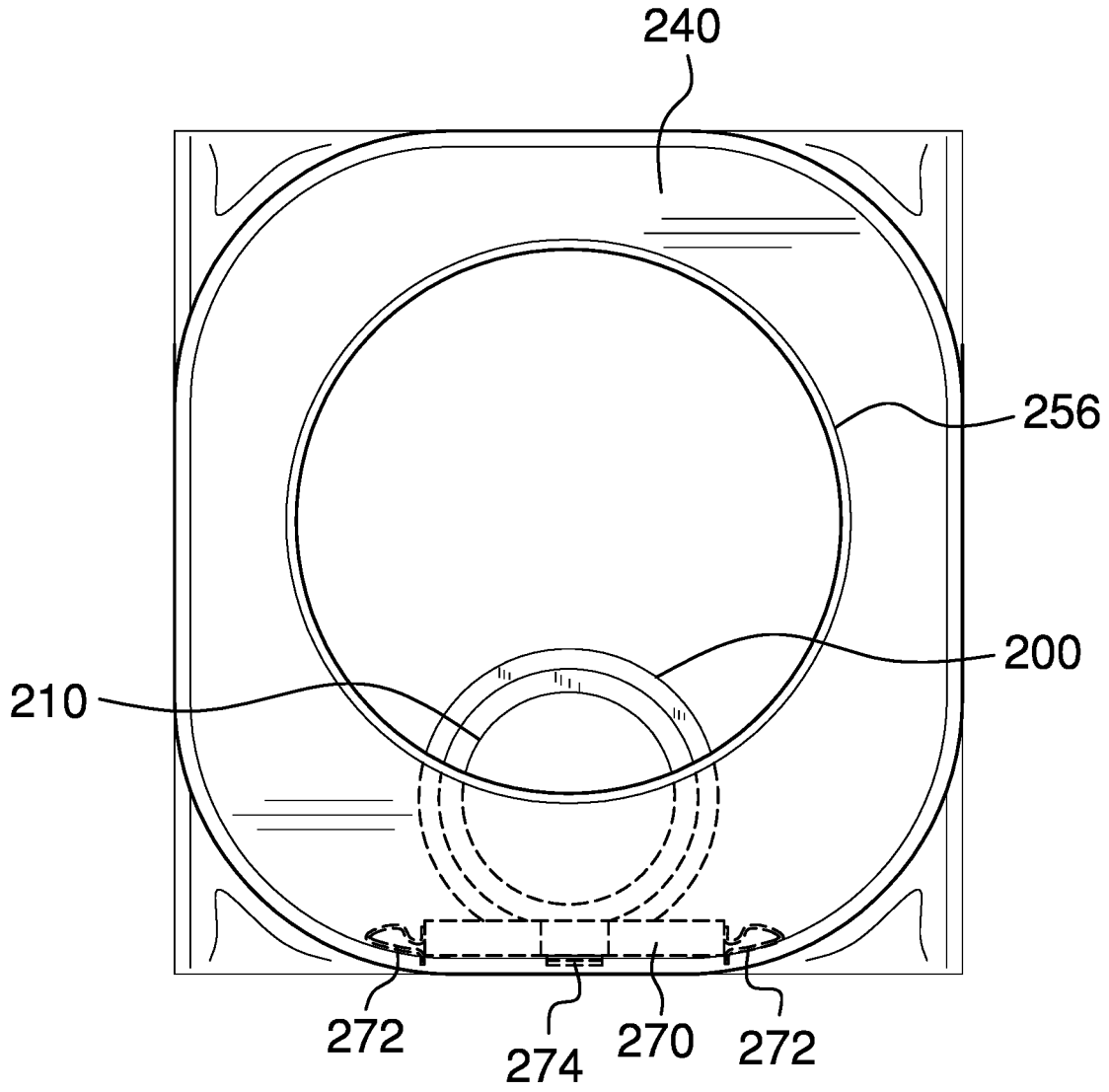
FIG. 5 is a top view of an embodiment of the disclosure.
Figure 6:
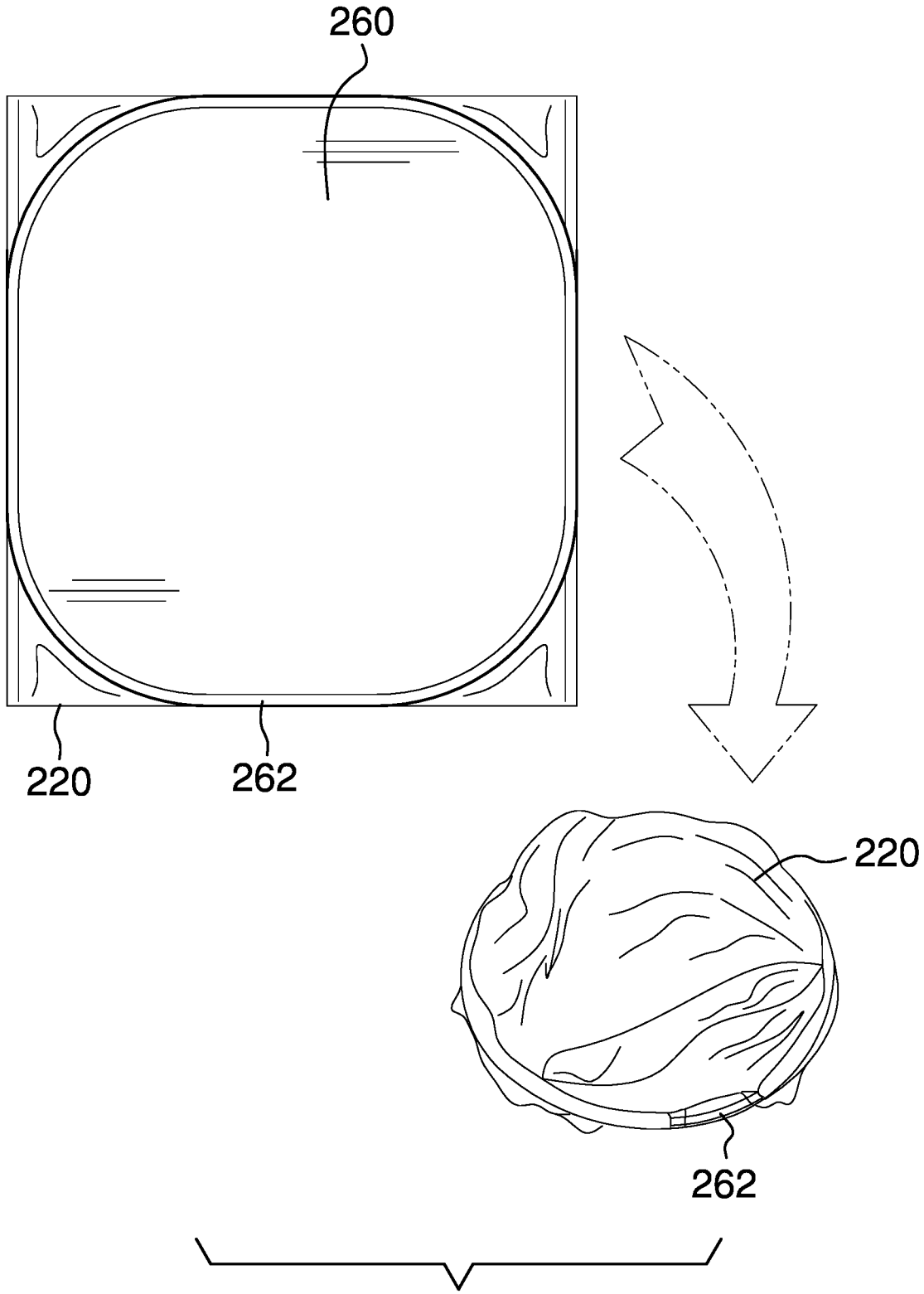
FIG. 6 is a detail view of an embodiment of the disclosure illustrating the collapse of the pop-up enclosure.

Detailed reference will now be made to a first potential embodiment of the disclosure, which is illustrated in FIGS. 1 through 6.

The portable toilet and pop-up enclosure 100 (hereinafter invention) comprises a portable toilet 200 and a pop-up enclosure 220. The invention 100 may be adapted to provide privacy to a child 900 while the child 900 uses the portable toilet 200 by enclosing the portable toilet 200 and the child 900 within the pop-up enclosure 220. The portable toilet 200 may collect feces and urine for disposal at a later time. The pop-up enclosure 220 may be adapted to block the view of the portable toilet 200 and the child 900 while providing ventilation and access by a parent. Both the portable toilet 200 and the pop-up enclosure 220 may collapse for transportation and/or storage.

The portable toilet 200 may be a potty that expands for use and collapses when not in use.

The portable toilet 200 may comprise a base toilet section 202, a top toilet section 204, and a plurality of intermediate toilet sections 206. The base toilet section 202 may be the lowest section of the portable toilet 200.

The top toilet section 204 may be the highest section of the portable toilet 200. The top toilet section 204 may be adapted for the child 900 to sit upon while using the portable toilet 200. The top toilet section 204 may comprise a seat aperture 210 through which the feces and the urine may fall.

The plurality of intermediate toilet sections 206 may be telescoping sections of the portable toilet 200. The bottom of the plurality of intermediate toilet sections 206 may couple to the top of the base toilet section 202. The top of the plurality of intermediate toilet sections 206 may couple to the bottom of the top toilet section 204. The plurality of intermediate toilet sections 206 may telescopically slide to increase the height of the portable toilet 200 when the top toilet section 204 is pulled up and to decrease the height of the portable toilet 200 when the top toilet section 204 is lowered. In some embodiments, the plurality of intermediate toilet sections 206 may lock when extended to retain the top toilet section 204 at an elevated height. As a non-limiting example, the plurality of intermediate toilet sections 206 may comprise a twist-lock such that rotating the plurality of intermediate toilet sections 206 in a first rotational direction may prevent the plurality of intermediate toilet sections 206 from telescopically changing height and rotating the plurality of intermediate toilet sections 206 in a second rotational direction that is opposite the first rotational direction may permit the plurality of intermediate toilet sections 206 to telescopically change height.

In some embodiments, a disposable bag (not shown) may be placed into the base toilet section 202. The disposable bag may control odor, may provide a visual indication of capacity, may accelerate breakdown of the waste matter, or combinations thereof. The fragrances and biocide may control odor.

After use, the portable toilet 200 may be collapsed and transported in an upright orientation to a next usage venue or to a facility where the feces, the urine may be emptied into a sanity sewer.

The pop-up enclosure 220 may be an enclosure that expands for use and collapses when not in use. The portable toilet 200 may be expanded and placed into the pop-up enclosure 220 during use.

The pop-up enclosure 220 may comprise flexible panels that define a front wall panel 230, a rear wall panel 232, a left side wall panel 234, a right side wall panel 236, a floor panel 238, and a top panel 240. The left edge of the front wall panel 230 may be coupled to the front edge of the left side wall panel 234. The right edge of the front wall panel 230 may be coupled to the front edge of the right side wall panel 236. The top edge of the front wall panel 230 may be coupled to the front edge of the top panel 240. The bottom edge of the front wall panel 230 may be coupled to the front edge of the floor panel 238. The left edge of the rear wall panel 232 may be coupled to the rear edge of the left side wall panel 234. The right edge of the rear wall panel 232 may be coupled to the rear edge of the right side wall panel 236. The top edge of the rear wall panel 232 may be coupled to the rear edge of the top panel 240. The bottom edge of the rear wall panel 232 may be coupled to the rear edge of the floor panel 238. The top edge of the left side wall panel 234 may be coupled to the left edge of the top panel 240. The bottom edge of the left side wall panel 234 may be coupled to the left edge of the floor panel 238. The top edge of the right side wall panel 236 may be coupled to the right edge of the top panel 240. The bottom edge of the right side wall panel 236 may be coupled to the right edge of the floor panel 238.

The front wall panel 230 may comprise an entrance aperture 250. The entrance aperture 250 may be adapted for the child 900 to enter and exit the pop-up enclosure 220.

The left side wall panel 234 may comprise a left mesh window 252. The left mesh window 252 may be a mesh-covered aperture. The right side wall panel 236 may comprise a right mesh window 254. The right mesh window 254 may be a mesh-covered aperture. The left mesh window 252 and the right mesh window 254 may provide ventilation for the inside of the pop-up enclosure 220.

The floor panel 238 may be adapted to cover the ground at a usage venue. The floor panel 238 may be adapted to increase the comfort level of the child 900 and may prevent contamination or slipping of the usage venue. The top panel 240 may comprise a top aperture 256. The top aperture 256 may be adapted to provide the parent with visibility of the child 900 and access to the child 900.

An individual wall panel 260 selected from the front wall panel 230, the rear wall panel 232, the left side wall panel 234, and the right side wall panel 236 may comprise a support frame 262 that is located at the perimeter of the individual wall panel 260. As a non-limiting example, the support frame 262 may be a semi-rigid wire that may be concealed within a hem located at the edge of the individual wall panel 260. The support frame 262 may force the individual wall panel 260 to be held taut. The support frames 262 within the front wall panel 230, the rear wall panel 232, the left side wall panel 234, and the right side wall panel 236 in conjunction with the floor panel 238 and the top panel 240 may define the shape of the pop-up enclosure 220 when the pop-up enclosure 220 is expanded. In some embodiments, the pop-up enclosure 220 may collapse by bending the support frames 262 into loops and gathering all flexible panels within the support frames 262.

In some embodiments, the rear wall panel 232 may comprise a seat panel 270. The seat panel 270 may be operable to cover the portable toilet 200 during use. The seat panel 270 may be hingedly coupled to the rear wall panel 232 and may further be supported by a plurality of support straps 272 coupled between the seat panel 270 and the rear wall panel 232. A hook and loop fastener 274 may secure the seat panel 270 in an upright orientation when the seat panel 270 is not in use.

In use, the pop-up enclosure 220 may be set up at a usage venue by allowing the support frames 262 to expand the front wall panel 230, the rear wall panel 232, the left side wall panel 234, and the right side wall panel 236. The floor panel 238 and the top panel 240 may constraint the shape of the pop-up enclosure 220 to have a square or rectangular footprint. The portable toilet 200 may be placed inside the pop-up enclosure 220 and the portable toilet 200 may be expanded by telescopically extending the plurality of intermediate toilet sections 206 to lift the top toilet section 204. The seat panel 270 may be lowered to cover the top toilet section 204. The child 900 may enter the pop-up enclosure 220 through the entrance aperture 250 or by being lowered into the pop-up enclosure 220 through the top aperture 256. The child 900 may sit upon the seat panel 270 and may leave feces and/or urine in the portable toilet 200. The portable toilet 200 may be collapsed and removed from the pop-up enclosure 220. The pop-up enclosure 220 may be collapsed and placed into a storage container to confine the pop-up enclosure 220 to a collapsed configuration.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used in this disclosure, "flexible" may refer to an object or material which will deform when a force is applied to it, which will not return to its original shape when the deforming force is removed, and which may not retain the deformed shape caused by the deforming force.

As used here, "footprint" may refer to a projection of an object onto the surface that supports the object. The projection is usually, but not always, vertically downward.

As used herein, "front" may indicate the side of an object that is closest to a forward direction of travel under normal use of the object or the side or part of an object that normally presents itself to view or that is normally used first. "Rear" or "back" may refer to the side that is opposite the front.

Unless noted otherwise, "ground" may refer to any surface which may support items and individuals. As non-limiting examples, ground may refer to an earthen surface whether covered by vegetation or not, a floor, a tarmac, a driveway, a road, a deck, bedrock, or a stage. The phrase "from the ground" may refer to performing an activity while standing on such a surface as opposed to climbing a ladder.

As used in this disclosure, a "hook and loop fastener" may be a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. The hook surface may sometime be referred to as a hard side fastener and the loop surface may sometimes be referred to as a soft side fastener.

As used in this disclosure, the term "intermediate" may refer to a location that lies between a first object and a second object As used in this disclosure, "orientation" may refer to the positioning and/or angular alignment of a first object relative to a second object or relative to a reference position or reference direction.

As used in this disclosure, a "perimeter" may be one or more curved or straight lines that bound an enclosed area on a plane or surface. The perimeter of a circle is commonly referred to as a circumference.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used herein, "resilient" or "semi-rigid" may refer to an object or material which will deform when a force is applied to it and which will return to its original shape when the deforming force is removed.

As used in this disclosure, "telescopic", "telescoping", and "telescopically" may refer to an object made of sections that fit or slide into each other such that the object can be made longer or shorter by adjusting the relative positions of the sections.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable toilet and pop-up enclosure comprising:

a portable toilet and a pop-up enclosure;

wherein the portable toilet and pop-up enclosure are adapted to provide privacy to a child while the child uses the portable toilet by enclosing the portable toilet and the child within the pop-up enclosure;

wherein the portable toilet collects feces and urine for disposal at a later time;

wherein the pop-up enclosure is adapted to block the view of the portable toilet and the child while providing ventilation and access by a parent;

wherein both the portable toilet and the pop-up enclosure collapse for transportation and/or storage;

wherein the pop-up enclosure comprises flexible panels that define a front wall panel, a rear wall panel, a left side wall panel, a right side wall panel, a floor panel, and a top panel;

wherein the rear wall panel comprises a seat panel;

wherein the seat panel is operable to cover the portable toilet during use;

wherein the seat panel is hingedly coupled to the rear wall panel and is further supported by a plurality of support straps coupled between the seat panel and the rear wall panel.

2. The portable toilet and pop-up enclosure according to claim 1 wherein the portable toilet is a potty that expands for use and collapses when not in use.

3. The portable toilet and pop-up enclosure according to claim 2 wherein the portable toilet comprises a base toilet section, a top toilet section, and a plurality of intermediate toilet sections;

wherein the base toilet section is the lowest section of the portable toilet;

wherein the base toilet section is operable as a holding tank to collect waste matter comprising the feces and the urine.

4. The portable toilet and pop-up enclosure according to claim 3 wherein the top toilet section is the highest section of the portable toilet;

wherein the top toilet section is adapted for the child to sit upon while using the portable toilet;

wherein the top toilet section comprises a seat aperture through which the feces and the urine fall into the base toilet section.

5. The portable toilet and pop-up enclosure according to claim 4 wherein the plurality of intermediate toilet sections are telescoping sections of the portable toilet;

wherein the bottom of the plurality of intermediate toilet sections couples to the top of the base toilet section;

wherein the top of the plurality of intermediate toilet sections couples to the bottom of the top toilet section;

wherein the plurality of intermediate toilet sections telescopically slide to increase the height of the portable toilet when the top toilet section is pulled up and to decrease the height of the portable toilet when the top toilet section is lowered.

6. The portable toilet and pop-up enclosure according to claim 5 wherein the plurality of intermediate toilet sections lock when extended to retain the top toilet section at an elevated height.

7. The portable toilet and pop-up enclosure according to claim 6 wherein a chemical liquid is placed into the base toilet section.

8. The portable toilet and pop-up enclosure according to claim 7 wherein after use, the portable toilet is collapsed and transported in an upright orientation to a next usage venue or to a facility where the feces, the urine, and/or the chemical liquid held within the base toilet section are emptied into a sanity sewer.

9. The portable toilet and pop-up enclosure according to claim 8 wherein the pop-up enclosure is an enclosure that expands for use and collapses when not in use;

wherein the portable toilet is expanded and placed into the pop-up enclosure during use.

10. The portable toilet and pop-up enclosure according to claim 9 wherein the left edge of the front wall panel is coupled to the front edge of the left side wall panel;

wherein the right edge of the front wall panel is coupled to the front edge of the right side wall panel;

wherein the top edge of the front wall panel is coupled to the front edge of the top panel;

wherein the bottom edge of the front wall panel is coupled to the front edge of the floor panel;

wherein the left edge of the rear wall panel is coupled to the rear edge of the left side wall panel;

wherein the right edge of the rear wall panel is coupled to the rear edge of the right side wall panel;

wherein the top edge of the rear wall panel is coupled to the rear edge of the top panel;

wherein the bottom edge of the rear wall panel is coupled to the rear edge of the floor panel;

wherein the top edge of the left side wall panel is coupled to the left edge of the top panel;

wherein the bottom edge of the left side wall panel is coupled to the left edge of the floor panel;

wherein the top edge of the right side wall panel is coupled to the right edge of the top panel;

wherein the bottom edge of the right side wall panel is coupled to the right edge of the floor panel.

11. The portable toilet and pop-up enclosure according to claim 10 wherein the front wall panel comprises an entrance aperture;

wherein the entrance aperture is adapted for the child to enter and exit the pop-up enclosure.

12. The portable toilet and pop-up enclosure according to claim 11 wherein the left side wall panel comprises a left mesh window;

wherein the left mesh window is a mesh-covered aperture;

wherein the right side wall panel comprises a right mesh window;

wherein the right mesh window is a mesh-covered aperture;

wherein the left mesh window and the right mesh window provide ventilation for the inside of the pop-up enclosure.

13. The portable toilet and pop-up enclosure according to claim 12 wherein the floor panel is adapted to cover the ground at a usage venue;

wherein the floor panel is adapted to increase the comfort level of the child and prevent contamination of the usage venue;

wherein the top panel comprises a top aperture;

wherein the top aperture is adapted to provide the parent with visibility of the child and access to the child.

14. The portable toilet and pop-up enclosure according to claim 13 wherein an individual wall panel selected from the front wall panel, the rear wall panel, the left side wall panel, and the right side wall panel comprises a support frame that is located at the perimeter of the individual wall panel.

15. The portable toilet and pop-up enclosure according to claim 14 wherein the support frame is a semi-rigid wire that is concealed within a hem located at the edge of the individual wall panel;

wherein the support frame forces the individual wall panel to be held taut;

wherein the support frames within the front wall panel, the rear wall panel, the left side wall panel, and the right side wall panel in conjunction with the floor panel and the top panel define the shape of the pop-up enclosure when the pop-up enclosure is expanded.

16. The portable toilet and pop-up enclosure according to claim 15 wherein the pop-up enclosure collapses by bending the support frames into loops and gathering all flexible panels within the support frames.

17. The portable toilet and pop-up enclosure according to claim 16 wherein a hook and loop fastener secures the seat panel in an upright orientation when the seat panel is not in use.

* * * * *